US005779355A

United States Patent [19]

Pullman

[11] Patent Number: 5,779,355

[45] Date of Patent: Jul. 14, 1998

[54] MIXING APPARATUS VENTURI COUPLED MULTIPLE SHEAR MIXING APPARATUS FOR REPAIRING A LIQUID-SOLID SLURRY

[75] Inventor: Douglas G. Pullman, Watford, Canada

[73] Assignee: Roger H. Woods Limited, Watford, Canada

[21] Appl. No.: 805,668

[22] Filed: Feb. 27, 1997

[51] Int. Cl.[6] ..... B01F 5/04; B01F 15/02

[52] U.S. Cl. ..... 366/137; 366/163.2; 366/173.2

[58] Field of Search ..... 366/136, 137, 366/159.1, 160.1, 160.2, 162.1, 163.1, 163.2, 167.1, 173.1, 173.2, 174.1, 175.2, 176.1

[56] References Cited

U.S. PATENT DOCUMENTS

| | | | |
|---|---|---|---|
| 2,073,784 | 3/1937 | Day | 366/136 X |
| 2,135,261 | 11/1938 | Rosmait | 366/136 |
| 2,453,465 | 11/1948 | Sloan | 366/136 |
| 2,795,403 | 6/1957 | Mead | 366/163.2 X |
| 3,233,874 | 2/1966 | Betulius | 366/136 X |
| 3,547,409 | 12/1970 | Jacuzzi . | |
| 3,799,195 | 3/1974 | Hermans . | |
| 4,043,539 | 8/1977 | Gilmer et al. . | |
| 4,084,795 | 4/1978 | Vaughn | 366/177 |
| 4,184,771 | 1/1980 | Day | 366/3 |
| 4,190,373 | 2/1980 | Zucker et al. | 366/160 |
| 4,210,166 | 7/1980 | Munie | 366/163.2 X |
| 4,285,601 | 8/1981 | Miner | 366/137 |
| 4,286,883 | 9/1981 | Johanson | 366/137 |
| 4,335,965 | 6/1982 | Faverty et al. | 366/150 |
| 4,474,254 | 10/1984 | Etter et al. | 366/136 X |
| 4,566,799 | 1/1986 | Ito et al. | 366/1 |
| 4,738,540 | 4/1988 | Banks | 366/137 |
| 4,753,535 | 6/1988 | King | 366/337 |
| 4,863,277 | 9/1989 | Neal et al. | 366/136 X |
| 4,895,451 | 1/1990 | Hockett | 366/150 |
| 4,981,368 | 1/1991 | Smith | 366/337 |
| 5,316,383 | 5/1994 | Begemann et al. | 366/160 |
| 5,366,287 | 11/1994 | Verstallen | 366/173 |
| 5,397,179 | 3/1995 | Berlin et al. | 366/337 |

*Primary Examiner*—Charles E. Cooley
*Attorney, Agent, or Firm*—Ian Fincham

[57] ABSTRACT

A multiple shear mixing apparatus for forming or treating solid-liquid mixtures including a pump selected for handling the solid-liquid mixtures, a rigid shear filter, a jet nozzle, a vacuum chamber surrounding the jet nozzle and having at least one port for introducing materials, a venturi tube coupled with the jet nozzle, a storage tank for the mixture having an internal jet mixer therein, the above components being connected in series such that storage tank contents are pumped through the screen filter, through the jet nozzle, through the chamber and through the venturi tube back to the storage tank. A bleed is fed preferably from between the shear filter and nozzle to drive the internal jet mixer. After cycling through this series of components until uniformly blended, product is withdrawn between the shear filter and nozzle.

14 Claims, 3 Drawing Sheets

MIXING APPARATUS VENTURI COUPLED MULTIPLE SHEAR MIXING APPARATUS FOR REPAIRING A LIQUID-SOLID SLURRY

FIELD OF THE INVENTION

The present invention relates to a multiple shear mixing apparatus for slurry type solid-liquid mixtures. The apparatus includes a storage tank having an internal jet mixer, a pump, a rigid shear filter, a jet nozzle with vacuum chamber surrounding same and inlet port in the chamber, a venturi tube coupled with the jet nozzle and a return to the storage tank. The apparatus can be used to prepare suspensions or mixtures such as drilling muds or to recondition used muds, and may be part of a drilling system.

BACKGROUND OF THE INVENTION

Slurry type solid-liquid mixtures have been prepared using various blenders and mixers usually individually and on a batch basis. Pumps have been used to off-load mixed product and occasionally may be part of the mixing apparatus. Note, for example, U.S. Pat. No. 4,285,601, issued Aug. 25, 1981 to Miner. Drilling muds require considerable shear in their formation and a shear mixing apparatus has been designed using annular concentric housings (see U.S. Pat. No. 4,184,771, issued Jan. 22, 1980 to Day).

In the context of detergent foam formation and delivery, a reference (U.S. Pat. No. 3,547,409, issued to Jacuzzi Dec. 15, 1970) has been noticed in which a jet nozzle and venturi have been combined in a flow line to enable mixing of foam ingredients, foam formation and delivery.

No references have been noticed to a multiple shear in-line (or loop) mixing apparatus for slurries, suspensions or drilling muds, in which materials may be repeatedly cycled to enhance mixing and uniformity before off-loading product.

SUMMARY OF THE INVENTION

The invention includes a multiple shear mixing apparatus for slurry type, or solid-in-liquid suspensions or other solid liquid mixtures, having in sequence:

a pump suitable for the solid-liquid mixture;

a rigid shear filter;

a jet nozzle;

a vacuum chamber surrounding the jet nozzle and having at least one port for introducing, starting or make-up materials;

a venturi tube coupled with the jet nozzle;

a storage tank for the mixture; and an internal jet mixer within the storage tank.

The above components are interconnected and able to pump mixture from the storage tank through the shear filter, then through the jet nozzle and chamber into the venturi tube, the nozzle creating a vacuum to enable introducing materials through the port into the chamber and hence into the venturi before entering the storage tank, with product mixture being off-loaded between the shear filter and the jet nozzle.

The invention further includes a multiple shear mixing device for fluid suspensions, comprising in interconnected sequence:

a. a pump with impeller;

b. a shear filter;

c. a coupled jet-nozzle plus venturi tube; and d. a tank having an internal jet mixer therein.

The invention further includes a method of mixing fluid suspensions, comprising:

providing at least part of the suspension components in a storage tank;

pumping the components from the storage tank through a shear filter;

passing the filtered components through a jet nozzle surrounded by a chamber, the jet nozzle causing a vacuum within the chamber;

directing the nozzle jet into a venturi tube with throat;

passing the output of the venturi into the storage tank;

introducing feed components into the chamber so as to pass through the venturi;

repeatedly cycling components out of, and returning to, the storage tank until uniformly mixed; and withdrawing mixed product between the shear filter and the jet nozzle.

It will be evident that the invention provides multiple shear sites including:

the pump which includes drive shear-causing members such as impellers;

the shear filter having altered flow direction and openings sized to cause shear;

the tank jet mixer in which the flow through the jet openings is subjected to shear;

the jet nozzle in which the flow is subject to shear; and the venture in which there is shear in the throat region.

Having here summarized the invention, reference will now be made to the accompanying drawings illustrating preferred embodiments.

BRIEF DESCRIPTION OF THE DRAWINGS

Similar numerals in the drawings denote similar elements.

DETAILED DESCRIPTION AND PREFERRED EMBODIMENTS

Figure 1:
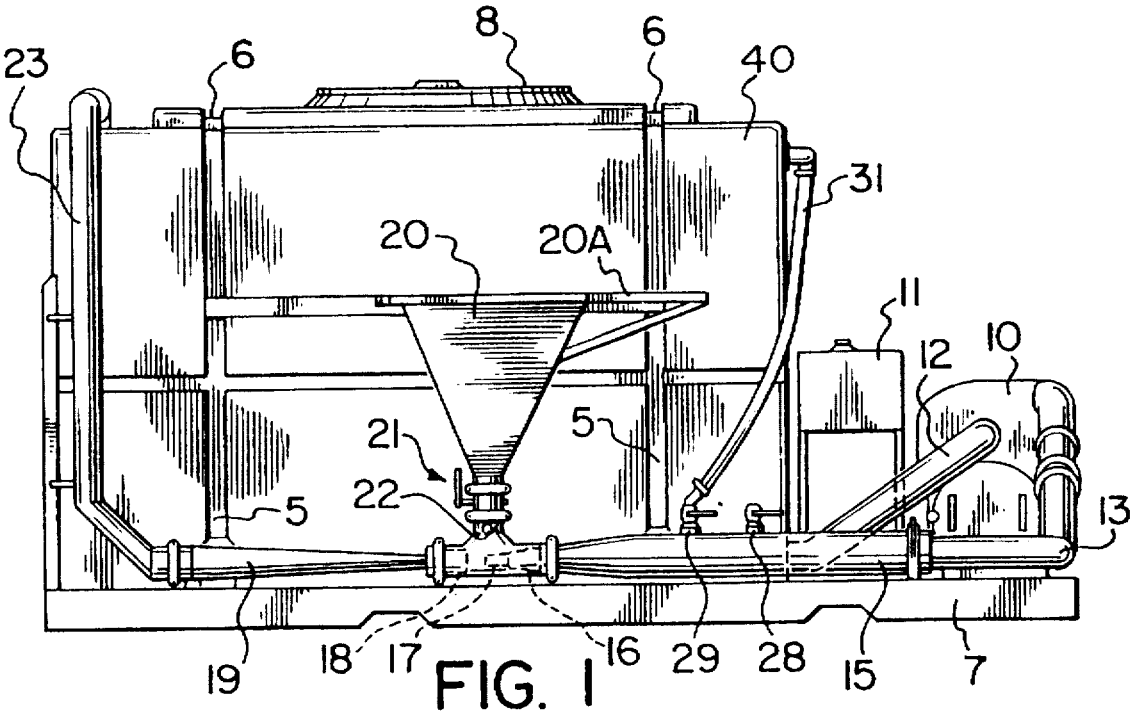
FIG. 1 is a side perspective view of a typical arrangement of the mixing apparatus.

While the pump may be any design to handle solid-liquid mixtures, one type found very suitable is a trash pump which can cope with the irregular sized solids encountered on recycling used drilling muds. The capacity and output of the pump needs to be selected in conjunction with the components particularly the shear site components (as illustrated below). The pump intake is from the storage tank preferably near the jet mixer location.

The shear filter is chosen to remove solids that are above the maximum size tolerated by the rest of the system. The shear at the filter openings helps to break down aggregates or agglomerates formed of smaller sized pieces. One filter type found very suitable is a cylindrical sleeve or tube having openings in the periphery, with the flow entering axially at one end and exiting radially through the openings.

Preferably, a bleed of flow that has passed through the filter is fed to the tank jet mixer in which the jet openings are not smaller (and preferably larger) than the filter openings to avoid plugging. It has been found preferable to withdraw mixed and filtered product after the filter and before the jet nozzle.

The tank jet mixer is designed to direct jets across the bottom of the tank to minimize settling and dead spots. A smaller number of vertical (upward) jets may be used to encourage bottom to top mixing in the tank. Various jet mixers with nozzles or openings may be used with one preferred type described in detail below.

The main jet nozzle opening is sized to suit the pump capacity and back pressure (a preferred example is given below). An operative nozzle opening size range for drilling mud type mixtures may be from about 0.5 inch to about 0.9 inch diameter. The nozzle and associated funnel are fitted into a chamber able to maintain whatever vacuum is generated by the nozzle flow.

The vacuum chamber is fitted with at least one inlet opening to introduce starting or make-up materials. It has been found preferable to have a valved hopper type inlet for solid materials, e.g. crude feed and a separate port for liquid materials, e.g. make-up liquid. The vacuum chamber encloses the upstream end of the venturi, with the venturi being directionally coupled with the main jet nozzle.

The venturi intake funnels the jet nozzle stream to the venturi throat and from there the flow diverges through the venturi tube, and onward to the storage tank. An operative venturi throat diameter range may be from about 1.0 inch to about 1.6 inch I.D. for mud type mixtures depending on the capacity of the pump and the size of nozzle used. In a preferred arrangement, the diameters of the shear filter openings, the nozzle, and venturi funnel openings and throat, are about ¼ inch, about 11/16 inch I.D., and about 3⅛ inch I.D. and 1 inch I.D., respectively.

The storage tank may be formed of plastic or metal, and sized to allow sufficient hold up of mixture to allow for batch or continuous operation as desired.

This multiple shear combination has several advantages. The combination allows for preparing mixtures from starting components, or from partial or used mixtures with make-up components added as required. The mixtures may be cycled out of and into the storage tank many times to increase uniformity and to allow for addition of various materials. It has been found to be desirable to have the final product outlet (between filter and nozzle) of smaller size than the circulating stream size, so that, as final product is off-loaded, more mixture is still being circulated, made up, filtered, etc. In fact, the combination may be operated in a continuous mode, or in a batch mode as desired.

Reference will now be made to the drawings and to one example which is typical (and found preferable) but not limiting.

Figure 2:
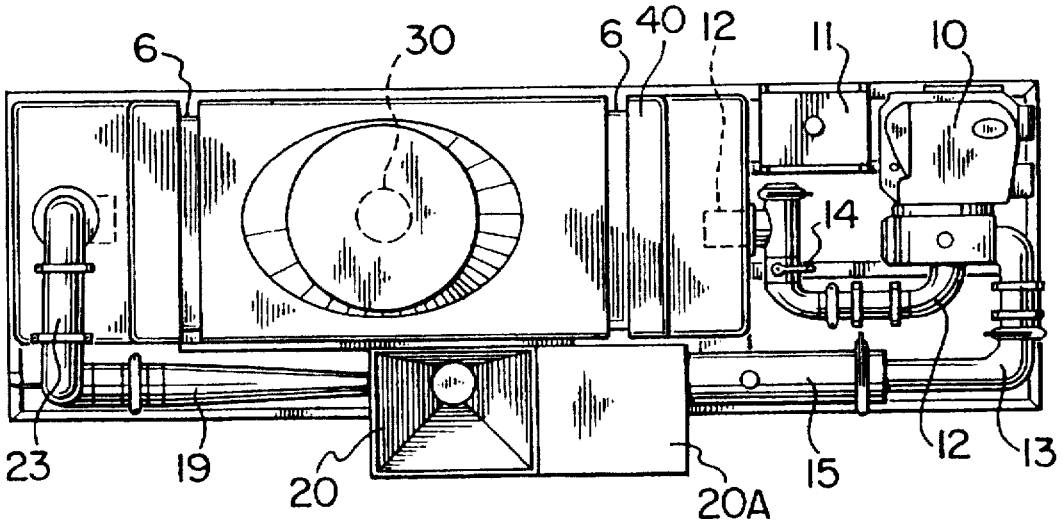
FIG. 2 is a top plan view of the apparatus of FIG. 1.

Referring to FIGS. 1 and 2, pump 10 is driven by a gasoline engine (not shown) fed from gas tank 11, and connected to input conduit 12 from storage tank 40. In the example, the pump selected is a centrifugal one with a two-vane impeller and diffuser. The type of pump used can be any suitable type to obtain a sufficiently high vacuum in the mixing chamber. The output of the pump 10 is through conduit 13 connected to filter housing 15. The selection of the filter will be made to achieve a filter size such that it removes large particle material, permitting passage only of particles capable of being processed by the balances of the system. This is desirable to prevent blockage of any openings in the nozzles, etc. Downstream of the filter element (shown in FIG. 3 at 15A), the off-loading valve is shown at 28 in FIG. 1. Valve 29 and conduit 31 carry a bleed flow to feed internal tank jet mixer 30 (via internal conduit 31A shown in FIG. 4). From housing 15, the flow is directed to nozzle intake 16 and nozzle 17 within vacuum chamber 18. Chamber 18 has a top hopper 20 attached to hopper table 20A. Hopper shut-off valve is shown at 21 and auxiliary intake port at 22. The flow then proceeds through venturi 19 and conduits 23 and 24A into storage tank 40. Conduit 24A is inside tank 40 such that the return flow is released near the top of the tank and preferably above tank jet mixer 30. Storage tank 40 has cover 8 over access hatch (not shown) and anchor straps 5 and 6. The combination is mounted on skid frame or pallet 7, or on a trailer or truck platform. Couplers of various types may be used.

The intake port 22 may be used for the addition of various components such as fresh water for the system, reclaimed mud from a reclaimer, powdered material from a source of the same, and various types of additives from primary sources. The addition of various components through inlet port 22 may be manual or through automated systems as desired, and of course, can take place while the system is operating.

Figure 3:
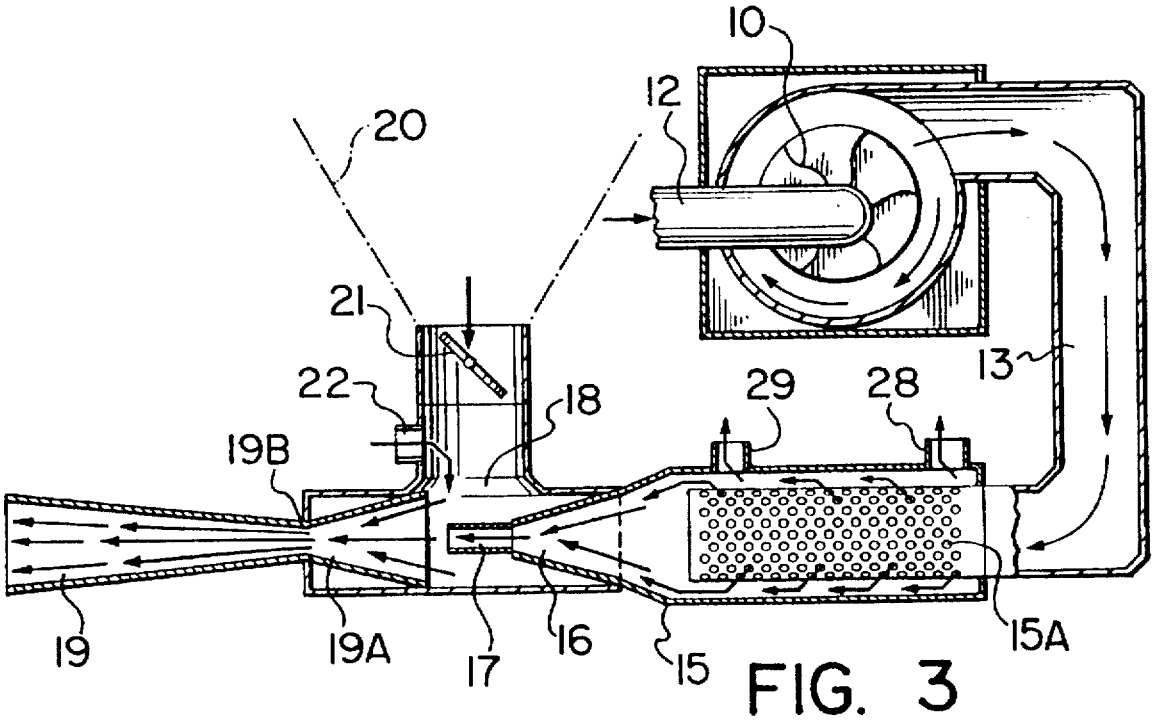
FIG. 3 is a schematic diagram of the fluid path through the primary mixing components.

In FIG. 3, arrows show the flow path in more detail. The inlet flow 12 from tank 40 enters pump 10 and exits through 13 to filter housing 15 containing filter tube 15A. Product outlet is shown at 28 which is a mixed product outlet and bleed to tank jet mixer is shown at 29. The flow then proceeds to nozzle intake funnel 16 and to nozzle 17. The hopper is indicated at 20 and the hopper shut-off valve at 21. The second intake port is shown at 22. The flow then proceeds through venturi intake 19A, throat 19B and venturi tube 19, then onward to storage tank 40.

The in-line filter may be mounted using quick-couplers for cleaning purposes; the filter housing may be such that it includes at least one access opening to permit manual flushing.

Figure 4:
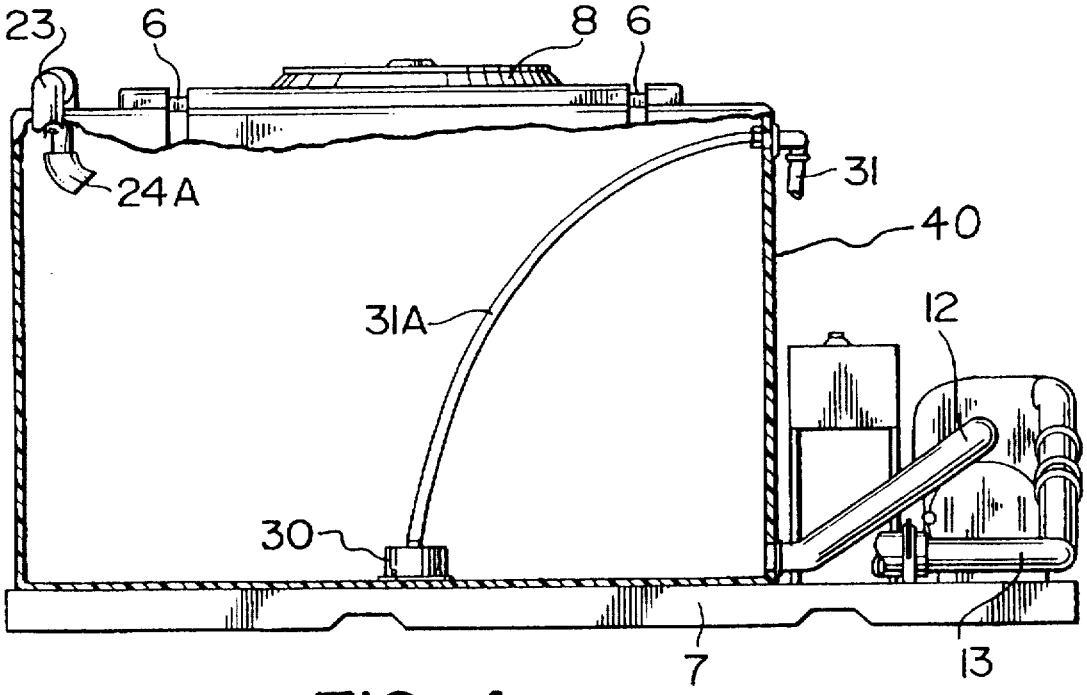
FIG. 4 is a vertical sectional view through the storage tank showing the location of, and feed conduit for, the tank jet mixer.

FIG. 4 shows storage tank 40 in vertical section, with the tank jet mixer at 30. The bleed line to the jet mixer is shown at 31A and the main flow return at 24A. The jet mixer 30 preferably is located centrally at or near the bottom of tank 40.

Figure 5:
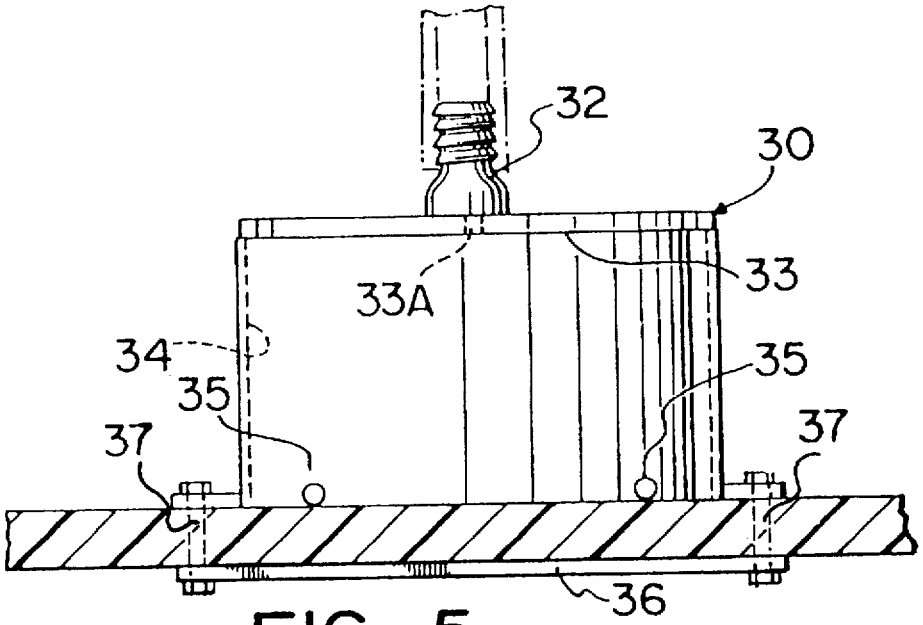
FIG. 5 is a vertical sectional view through one typical tank jet mixer.

FIG. 5 is a vertical section through an example of jet mixer 30 showing inlet coupler 32, top plate 33, side wall 34, bottom plate 36, and mounting holes 37. Holes for horizontal jets, for example five such jets are shown at 35 in wall 34. Two holes for vertical jets in top plate 33 are shown at 33A.

Figure 6:
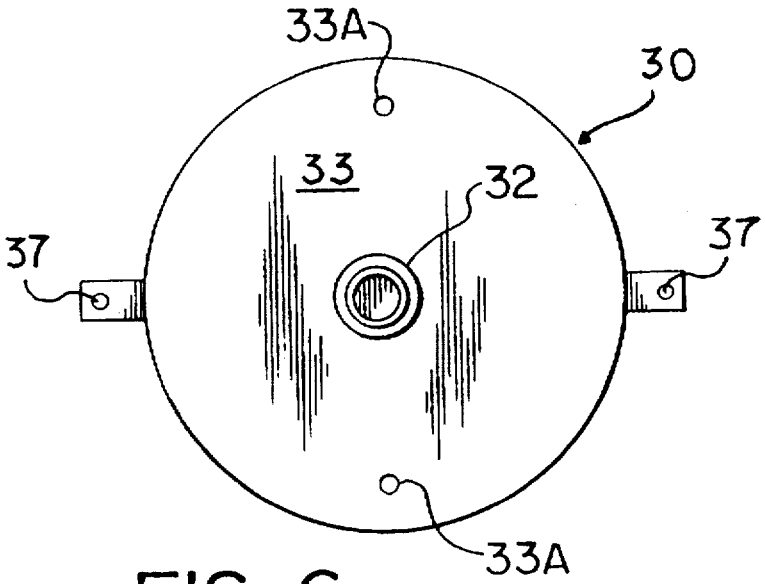
FIG. 6 is a top plan view of the tank jet mixer of FIG. 5 primarily showing the horizontal base and the location of the jet holes in the vertical walls just above the base.

FIG. 6 is a top plan view of top plate 33 showing inlet coupler 32 and vertical jet holes 33A. A mounting plate (not shown) may be used having holes aligned with holes 37, for mounting the jet mixer 30 to the bottom of tank 40.

Referring now to one specific example, the pump 10 is selected to have a flow capacity of 20,000 U.S. gallons per hour at a 75 foot head (water).

In the above described arrangement, various valves can be incorporated into the system at different points for closing different sections as desired for maintenance or other purposes and back pressure of about 30 psi.

The apparatus and method of the present invention are particularly useful in drilling operations where clays such as bentonite, which are used in such operations, create site problems. With the apparatus and method of the present invention, site problems are reduced or eliminated by recovery as opposed to having the mud come to the surface at the drilling site and flood the work area. The method and apparatus of the present invention can be used in combination with existing drilling equipment and techniques, to thereby provide a more effective and environmentally acceptable solution to the problems facing this field. By recovery of the bentonite, greater economy can be achieved and the cost of disposal of spent mud at a site is reduced. Recovery of the spent mud for further use provides further economic advantages.

In carrying out the method of the present invention using the arrangement described above, circulation of the recovered material through the system may be carried out for relatively brief times up to more extended times as required or desired. Thus, given the type of equipment described cycling times of 5 to 10 minutes, e.g. typically 7 minutes, may be used. In the method, using the outlet arrangement described above, as the fluid is off-loaded, more material is still being circulated and filtered/sheared. It should be noted that with typical drill mud or powders, the circulation, drilling, filtering and nozzle effect makes the resulting product "cream" or fluff up, which is a desirable benefit since less raw product will be required. Still further, as the raw product is introduced into the hopper or shelf loading port, given the arrangement contemplated by this invention, it will be broken down by the nozzle force and admixed with the material in the tank which is being recirculated.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A method of mixing fluid suspensions comprising fluid suspension components, said method comprising:

providing at least part of the suspension components in a storage tank;

pumping said components from the storage tank through a shear filter;

passing the filtered components through a jet nozzle surrounded by a chamber, the jet causing a vacuum within the chamber;

directing the nozzle jet into a venturi tube with throat, said venturi tube having an output;

passing the output of the venturi tube into the storage tank;

introducing feed components into said chamber then through the venturi tube;

repeatedly cycling components out of, and returning to, the storage tank until uniformly mixed; and withdrawing mixed product between the shear filter and the jet nozzle.

2. A multiple shear mixing apparatus for treating a slurry-type solid/liquid mixture, comprising;

a storage tank for the mixture;

a pump connected to the tank and suitable for pumping said mixture from the storage tank, a shear filter connected to receive the mixture from the pump;

a jet nozzle downstream of the shear filter;

a venturi tube located to receive mixture from the jet nozzle;

a vacuum chamber surrounding the jet nozzle and an inlet end of the venturi tube and having at least one port for the introduction of starting or make-up materials to the chamber;

an off-loading outlet for the mixture between said shear filter and said jet nozzle;

a jet mixer within the storage tank;

the above components being interconnected and adapted to pump said mixture from the tank, through the filter, then through the jet nozzle and chamber, hence into the venturi tube and from the venturi tube into the storage tank, while allowing some of the mixture to be removed from the apparatus through said off-loading outlet.

3. The mixing apparatus of claim 2, wherein the jet mixer is fed via a bleed line from between the shear filter and the jet nozzle.

4. The mixing apparatus of claim 3, wherein said pump is connected to said shear filter, and wherein there is included conduit means connecting said shear filter to said jet nozzle, and means for recycling the mixture through said pump and shear filter.

5. The mixing apparatus of claim 2, wherein the shear filter is an axial flow cylindrical sleeve with holes therein, the flow through the holes being radial.

6. The mixing apparatus of claim 5, wherein the pump, shear filter, jet nozzle, jet mixer and venturi tube are selected to handle used drilling muds.

7. The mixing apparatus of claim 2, wherein the pump, shear filter, jet nozzle, jet mixer and venturi tube are selected to handle used drilling muds.

8. The mixing apparatus of claim 7, wherein the venturi tube includes a venturi throat: the jet nozzle and venturi throat each have an inside diameter; and wherein the said inside diameters of the jet nozzle and venturi throat are about 0.5 inch to 0.9 inch diameter, and 1.0 to 1.6 inch diameter, respectively.

9. The mixing apparatus of claim 8, wherein the pump is a trash pump having a capacity of about 20,000 U.S. gallons per hour at about a 75 foot head (water) and back pressure of about 30 psi.

10. The mixing apparatus of claim 9, arranged as a unit on a carrying means.

11. The mixing apparatus of claim 2, wherein said pump is connected to said shear filter, and wherein there is included conduit means connecting said shear filter to said jet nozzle, and means for recycling the mixture through said pump and shear filter.

12. The mixing apparatus of claim 11, wherein the pump, shear filter, jet nozzle, jet mixer and venturi tube are selected to handle used drilling muds.

13. The mixing apparatus of claim 2, wherein the said at least one port of the vacuum chamber comprises a first port connected to a hopper and a second port separate from the first port.

14. The mixing apparatus of claim 2, arranged as a unit on a carrying means.

* * * * *

UNITED STATES PATENT AND TRADEMARK OFFICE

CERTIFICATE OF CORRECTION

PATENT NO. : 5,779,355
DATED : July 14, 1998
INVENTOR(S) : Pullman, Douglas G.

It is certified that error appears in the above-identified patent and that said Letters Patent is hereby corrected as shown below:

Title page,
The Title should read -- MIXING APPARATUS VENTURI COUPLED MULTIPLE SHEAR MIXING APPARATUS FOR PREPARING A LIQUID-SOLID SLURRY -- and not "...REPAIRING...".

Signed and Sealed this

Twenty-sixth Day of February, 2002

*Attest:*

*Attesting Officer*

JAMES E. ROGAN
*Director of the United States Patent and Trademark Office*